US011753747B2

(12) United States Patent
Mohr et al.

(10) Patent No.: US 11,753,747 B2
(45) Date of Patent: Sep. 12, 2023

(54) PROCESS FOR OPERATING AN AIR-JET SPINNING DEVICE, YARN GUIDE CHANNEL AND AIR-JET SPINNING MACHINE COMPRISING SUCH A YARN GUIDE CHANNEL

(71) Applicant: Saurer Spinning Solutions GmbH & Co. KG, Uebach-Palenberg (DE)

(72) Inventors: Michael Mohr, Schwalmtal (DE); Heinz-Josef Peuker, Wegberg (DE); Chandrassekaran Seshayer, Herzogenrath (DE); Ralf Siewert, Schwalmtal (DE); Joachim Sobkowiak, Mönchengladbach (DE); Paul Straaten, Schwalmtal (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 293 days.

(21) Appl. No.: 16/630,937

(22) PCT Filed: Jul. 13, 2018

(86) PCT No.: PCT/EP2018/069160
§ 371 (c)(1),
(2) Date: Jan. 14, 2020

(87) PCT Pub. No.: WO2019/012143
PCT Pub. Date: Jan. 17, 2019

(65) Prior Publication Data

US 2020/0224337 A1 Jul. 16, 2020

(30) Foreign Application Priority Data

Jul. 14, 2017 (DE) ..... 10 2017 115 939.8

(51) Int. Cl.
*D01H 1/115* (2006.01)
*D01H 15/00* (2006.01)
*B65H 51/16* (2006.01)

(52) U.S. Cl.
CPC ..... *D01H 1/115* (2013.01); *B65H 51/16* (2013.01); *D01H 15/002* (2013.01)

(58) Field of Classification Search
CPC .. D01H 4/48; D01H 4/50; D01H 4/52; D01H 15/00; D01H 15/002; D01H 15/013
(Continued)

(56) References Cited

U.S. PATENT DOCUMENTS 4,346,504 A 8/1982 Birk et al.
5,118,226 A 6/1992 Horii et al.
(Continued)

FOREIGN PATENT DOCUMENTS

CN 1032824 A 5/1989
CN 1405376 A 3/2003
(Continued)

OTHER PUBLICATIONS

International Search Report and Written Opinion, PCT/EP2018/069160, dated Feb. 6, 2019, 20 pages.
(Continued)

*Primary Examiner* — Shaun R Hurley
(74) *Attorney, Agent, or Firm* — Nelson Mullins Riley & Scarborough LLP

(57) ABSTRACT

A process for operating an air-jet spinning device such that after a spinning interruption the yarn end of the spun yarn accumulated on a take-up package is picked up by a suction nozzle and transferred to a yarn end preparation device. The yarn end is processed in the yarn end preparation device and is then transferred to a first area of an outlet opening of the spinning cone, the yarn end is pneumatically transported to
(Continued)

a second area of an inlet opening of the spinning cone and is positioned there within the air-jet spinning device at a distance in front of the inlet opening, the drafting system of the relevant workstation is raised and the sliver is conveyed through a sliver guide of the nozzle block into the second area of the inlet opening of the spinning cone and there spun onto the prepared yarn end of the spun yarn.

7 Claims, 8 Drawing Sheets

(58) Field of Classification Search
USPC ..... 57/261, 263
See application file for complete search history.

(56) References Cited

U.S. PATENT DOCUMENTS

| | | | | |
|---|---|---|---|---|
| 5,177,835 | A * | 1/1993 | Ogawa | D01H 15/00 19/271 |
| 5,569,865 | A | 10/1996 | Profe et al. | |
| 6,817,169 | B2 | 11/2004 | Straaten | |
| 8,904,742 | B2 * | 12/2014 | Stephan | D01H 15/002 57/263 |
| 2003/0029153 | A1 | 2/2003 | Straaten | |
| 2003/0029154 | A1 | 2/2003 | Straaten | |
| 2013/0067878 | A1 * | 3/2013 | Stephan | D01H 1/115 57/78 |
| 2013/0067879 | A1 * | 3/2013 | Stephan | D01H 5/68 57/78 |
| 2013/0333347 | A1 * | 12/2013 | Stephan | D01H 4/02 57/263 |
| 2014/0283496 | A1 * | 9/2014 | Stahlecker | D01H 15/00 57/263 |
| 2016/0355954 | A1 * | 12/2016 | Pohn | D01H 4/48 |

FOREIGN PATENT DOCUMENTS

| | | | |
|---|---|---|---|
| CN | 101600825 | A | 12/2009 |
| CN | 106222820 | A | 12/2016 |
| DE | 1115163 | B | 10/1961 |
| DE | 3518316 | A1 | 11/1986 |
| DE | 40 36 119 | C2 | 7/1994 |
| DE | 199 26 492 | A1 | 4/2000 |
| DE | 10202781 | A1 | 7/2003 |
| DE | 103 35 651 | A1 | 3/2005 |
| DE | 10 2005 022 187 | A1 | 11/2006 |
| DE | 10 2007 009 074 | A1 | 8/2008 |
| DE | 102011 053 810 | A1 | 5/2013 |
| EP | 298537 | A2 | 1/1989 |
| EP | 0311987 | A1 | 4/1989 |
| EP | 1 072 702 | A2 | 1/2001 |
| EP | 2679711 | A1 | 1/2014 |
| EP | 3100971 | A1 | 12/2016 |
| EP | 3168344 | A1 | 5/2017 |
| JP | 2003212438 | A | 7/2003 |
| JP | 2016223061 | A | 12/2016 |
| WO | 2019012143 | A2 | 1/2019 |

OTHER PUBLICATIONS

Office Action from Chinese Patent Application No. 201880046356.5, dated Sep. 3, 2021, all enclosed pages cited.
Office Action from Chinese Patent Application No. 201880046356.5, dated Dec. 22, 2021, all enclosed pages cited.

* cited by examiner

PROCESS FOR OPERATING AN AIR-JET SPINNING DEVICE, YARN GUIDE CHANNEL AND AIR-JET SPINNING MACHINE COMPRISING SUCH A YARN GUIDE CHANNEL

CROSS-REFERENCE TO RELATED APPLICATIONS

This application claims priority from PCT International Patent Application No. PCT/EP2018/069160, filed Jul. 13, 2018, which claims priority from German National Patent Application No. 10 2017 115 939.8, filed Jul. 14, 2017, entitled "Verfahren zum Betreiben einer Luftspinnvorrichtung, Fadenleitkanal und Luftspinnmaschine umfassend einen solchen Fadenleitkanal", the entire contents of which are incorporated herein by reference.

FIELD OF THE INVENTION

The present invention relates to, on the one hand, a process for operating an air-jet spinning device after a spinning interruption. The air-jet spinning device is preceded by a drafting system for warping a sliver in the run direction of the sliver and is followed by a single motor-driven yarn take-up device for taking up a yarn spun by the air-jet spinning device.

Secondly, the present invention relates to a yarn guide channel for arrangement between a spinning device and a winding device of a textile machine creating take-up packages, such as an air-jet spinning machine, as well as such an air-jet spinning machine. The yarn guide channel is particularly suitable for carrying out the process, in which case the yarn guide channel forms a passage channel for a yarn running between the spinning device and the winding device.

BACKGROUND OF THE INVENTION

Various processes and spinning devices are known in the textile industry in connection with the production of textile yarns. Ring spinning machines and/or open-end rotor spinning machines, for example, have long been widely used and are tried-and-tested. Furthermore, so-called air-jet spinning machines have also been disclosed, especially in connection with the processing of synthetic yarn material.

The spinning processes mentioned above and the associated spinning processes are also described in relative detail in the patent literature in numerous patent specifications.

German patent publication DE 40 36 36 119 C2, for example, describes an air-jet spinning device of an air-jet spinning machine, which has a nozzle block arranged at the inlet side and a hollow spinning spindle mounted in a rotatable manner downstream. In addition to air injection nozzles for generating a circulating air flow, the nozzle block also has a sliver guide that acts as a swirl stop for a fed sliver.

During the spinning process, the circulating air flow initiated by the air injection nozzles in the area of the fibre inlet opening of the nozzle block leads to a suction flow which assists in the introduction into the air-jet spinning device of the sliver warped in an upstream drafting system. This means that the sliver introduced into the air-jet spinning device passes through the nozzle block to the inlet opening of a hollow spinning spindle rotating during the spinning process and acted upon by a drive belt.

When the sliver enters the rotating spinning spindle, the free fibre ends are looped around the conical spindle head of the rotating spinning spindle by means of the circulating air flow and wind themselves spirally around so-called core fibres as the yarn is drawn into the spindle. This means that, during the spinning process, the core fibres together with the so-called wrapping fibres form a new yarn.

A comparable device for producing a yarn by means of a circulating air flow is also disclosed in German Patent Publication DE 199 26 492 A1. However, this air-jet spinning device of prior art has a stationary spinning cone instead of a rotationally mounted one.

In this air-jet spinning device, the sliver to be spun is also inserted into the air-jet spinning device via a sliver guide arranged in a nozzle block and enters an inlet opening of a stationary hollow spinning cone.

As already described above in connection with German Patent Publication DE 40 36 119 C2, the sliver is exposed to a circulating air flow in the area of the spinning cone inlet opening, which is initiated by air injection openings arranged in the nozzle block. The circulating air flow then places the free fibre ends of the sliver, as has been disclosed, around the head of the spinning cone and also assists in the insertion of the sliver into the air-jet spinning device. In this air-jet spinning device of prior art, the free fibre ends also wind themselves spirally around the core fibres as so-called wrapping fibres, forming a yarn.

If the spinning process is interrupted in such an air-jet spinning device, for example due to a break in the supplied sliver or because the spun yarn has been separated by a controlled cut of a yarn clearer, the yarn end of the already spun yarn, usually accumulated on an associated cross-wound package, must first be retrieved during the subsequent piecing process to eliminate the interruption and be transported through the air-jet spinning device to the area of the drafting system. An air flow directed against the operational transport direction of the yarn is often used as the transport medium within the air-jet spinning device.

German Patent Publication DE 10 2011 053 810 A1, for example, describes an air-jet spinning device in which the transport medium is generated by a compressed air source. In this air-jet spinning device of prior art, the compressed air flows through an injection channel integrated into the spinning cone of the air-jet spinning device, which, for example, opens into the yarn take-up channel of the spinning cone. This means that for the return transport of a yarn end through the air-jet spinning device, compressed air is applied to the injection channel, which produces a suction air flow in the yarn take-up channel of the spinning cone directed towards the drafting system, which conveys the yarn end of a yarn retracted from the cross-wound package of the workstation to the delivery roller pair of a drafting system arranged in front of the air-jet spinning device.

Although such an injector channel integrated into the spinning cone of an air-jet spinning device is characterised by quite good functional reliability, the production of such an injection channel integrated into the spinning cone is relatively challenging and thus relatively expensive.

An air-jet spinning device for producing a yarn by means of a circulating air flow is also described in German Patent Publication DE 10 2007 009 074 A1. This air-jet spinning device also has a hollow spinning cone arranged in a spinning housing and a nozzle block that can be acted upon with compressed air to generate a circulating air flow. However, the spinning housing of this air-jet spinning device of prior art also has an expansion chamber, which is equipped with an exhaust air duct. A compressed air source can be connected to the exhaust air duct for the piecing process, while the nozzle block can be simultaneously separated from the compressed air supply. This means that compressed air, which is blown into the spinning housing via the exhaust air duct, generates an air flow in the expansion chamber which runs along the spinning cone in the direction of the sliver guide arranged in the nozzle block. This creates suction in the area of the spinning cone inlet opening with which a yarn can be transported through the spinning cone against the spinning direction.

This means that the air-jet spinning device in accordance with German Patent Publication DE 10 2007 009 074 A1 takes advantage of the fact that the expansion space for dissipating the compressed air introduced via the nozzle block during the spinning process has an exhaust air duct, which can also be used as an injector nozzle in connection with the piecing process. Overall, the production of such an air-jet spinning device is relatively simple and therefore inexpensive.

Air-jet spinning machines equipped with the air-jet spinning devices described above have relatively good efficiencies, especially when processing synthetic yarn material. However, the processes used in the air-jet spinning devices of prior art in connection with restarting spinning after a spinning interruption in order to reconnect the warped sliver with the yarn already produced are in need of improvement.

EP 1 072 702 A2, for example, describes a state-of-the-art air-jet spinning device in which, after a spinning interruption, the yarn end of the already spun yarn is transported by means of a transfer arm into the vicinity of the outlet opening of the spinning cone referred to as the spindle. The yarn is then sucked in by a suction element positioned in front of the air-jet spinning device in the direction of the yarn travel. This means that the yarn is conveyed through the spinning cone against the direction of the yarn travel during the spinning process and sucked into the suction element. The sliver coming out of the drafting system that was processed in the drafting system is also sucked into the suction element and intertwined with the yarn in the suction element. The two intertwined fibre elements are then sucked into the spinning cone of the air-jet spinning device for final connection.

With this process of prior art, however, defects often occur during the preparation phase for the yarn joining, which interfere with or even prevent the formation of a yarn joining. Another disadvantage of this process of prior art is that the yarn section containing the connection between the yarn and sliver is significantly thicker than the rest of the yarn. Since such a thick spot in the end product, for example in a fabric, is often negatively perceived, it represents a considerable quality defect.

A comparable process for connecting a warped sliver to a spun yarn after a spinning interruption is also described in German Patent Publication DE 103 35 651 A1.

In this known process, after a spinning interruption, the spun yarn is first transported backwards, i.e. in the opposite direction to the yarn run direction usual during the spinning process, through a stationary pair of draw-off rollers arranged behind the air-jet spinning device and through the air-jet spinning device to a drafting system also stationary in front of the air-jet spinning device. The yarn end is then positioned with a predefinable length between the opened pair of outlet rollers of the drafting system and the yarn end is prepared. Then, the pair of outlet rollers of the drafting system is closed and the drafting system and the pair of draw-off rollers are started, with the result that the prepared yarn end of the yarn is rolled into the sliver and connected to it.

This joining process of prior art also creates a joint that is thicker than the rest of the yarn and thus represents a not inconsiderable quality defect.

In order to minimise the occurrence of such defects when restarting an air-jet spinning device, it has also already been proposed to work with an auxiliary yarn when starting an air-jet spinning device.

In such a process, as for example described in German Patent Publication DE 10 2005 022 187 A1, the auxiliary yarn is inserted into the air-jet spinning device in two stages. In a first stage, the auxiliary yarn is first conveyed through the sliver channel of a nozzle block from the front by means of an injector flow and then inserted in a second stage into the spinning cone of the air-jet spinning device, the introduction of the auxiliary yarn into the spinning cone taking place by applying vacuum to the spinning cone, which is initiated by a suction device positioned in the area of the output opening of the spinning cone.

The air-jet spinning device used for this process consists of two displaceably mounted components which are positioned somewhat apart from each other during the insertion of the auxiliary yarn into the sliver channel of the nozzle block and during the insertion of the auxiliary yarn into the spinning cone. This means that the auxiliary yarn can be picked up manually and easily inserted into the nozzle block or into the spinning cone. After insertion of the auxiliary yarn, the air-jet spinning device is closed and the piecing process is started. The sliver warped in the drafting system is rolled onto the auxiliary yarn and safely conveyed through the air-jet spinning device, during which a new yarn is produced. Afterwards, both the auxiliary yarn and the auxiliary yarn/sliver connection point are removed again and the new yarn is connected to a top yarn brought back from the cross-wound package almost identically to the yarn by means of a yarn splicing device.

The process described in German Patent Publication DE 10 2005 022 187 A1 can be used both to make the piecing processes of air-jet spinning devices safer and to create high-quality yarn joints. However, here, too, the design effort required at the workstations in order to be able to use the process described above advantageously is relatively high.

Based on the air-jet spinning devices described above as an example, the invention is intended to provide a possibility by means of which, after a spinning interruption, a new, qualitatively improved piecer can be produced using commercially available air-jet spinning devices, in which case the associated air-jet spinning device is kept as simple and reliable as possible with regard to its design complexity.

SUMMARY OF THE INVENTION

In accordance with a first aspect of the present invention, a process for operating an air-jet spinning device is proposed for this purpose, which is preceded by a drafting system for warping a sliver in the run direction of the sliver and is followed by a single motor-driven yarn take-up device for taking off a yarn spun by means of the air-jet spinning device. In accordance with the proposed process, after a spinning interruption, the yarn end of the spun yarn accumulated on a take-up package, generally referred to as a cross-wound package, is picked up by means of a suction nozzle and transferred to a yarn end preparation device downstream of the air-jet spinning device. In the yarn end preparation device, the yarn end is processed and then transferred to the area of the outlet opening of the spinning cone, from where the yarn end is transported to the inlet opening of the spinning cone by means of the yarn take-up device, which can be driven reversibly in accordance with the present invention, and is positioned there within the air-jet spinning device at a distance in front of the inlet opening. Subsequently, the drafting system of the relevant workstation is raised and the sliver is conveyed through the sliver guide of the nozzle block into the area of the spinning cone inlet opening and spun onto the prepared yarn end of the spun yarn.

Advantageous embodiments of the invention are the subject matter of the dependent claims.

The proposed process has the particular advantage that it can be used successfully without the need for new, complex developments on the air-jet spinning devices. This means that by using components that have long been known and proven in textile machine construction, such as a yarn take-up device driven by a single motor, a suction nozzle and/or a small holding and opening tube, combined with a relatively simple and minor modification of an air-jet spinning device of prior art, a reliable, cost-effective air-jet spinning device can be produced in a relatively simple manner, which enables the proposed process to be carried out without any problems.

The proposed process can also ensure that the quality of the sliver/yarn joints produced during piecing is improved compared to comparable joints of known processes.

In a preferred embodiment, the yarn end of the spun or finished yarn that has run onto the take-up package after a spinning interruption is picked up by means of a suction nozzle, which is part of each of the workstations of the air-jet spinning machine.

However, in an alternatively preferred embodiment there may also be provision for the yarn end running onto the take-up package to be picked up by means of a suction nozzle, which is part of a mobile service unit supplying the numerous workstations of an air-jet spinning machine.

The preferred embodiment, in which each workstation has its own suction nozzle, has the advantage that such a design reliably avoids unnecessary waiting times, which has a positive effect on the efficiency of the air-jet spinning machine. This means that even if there is a spinning interruption at several workstations simultaneously on the air-jet spinning machine, the yarn accumulated on the take-up package can always be immediately brought back to the air-jet spinning device through the suction nozzle of the workstation concerned, prepared and the piecing process can then be started immediately at the workstation.

If the suction nozzle is part of a mobile service unit supplying the numerous workstations of an air-jet spinning machine, this results in a very cost-effective device. However, in such a case, there is a risk that a workstation may remain unsupplied for a while because the service unit is still employed at another workstation where a piecing process must also be carried out.

Furthermore, it is preferable for the preparation of the yarn end for the piecing process to be carried out by a yarn end preparation device which is equipped with a so-called small holding and opening tube to prepare the yarn end of the spun yarn for the piecing process. Such small holding and opening tubes, as described in relative detail in German Patent Publication DE 35 18 316 A1 or DE 102 02 781 A1, for example, have long since been disclosed and are tried-and-tested components in textile machine construction.

Another advantage of the process with another preferred embodiment in which the drafting system of the workstation can be driven by a single motor in order to be able to feed the sliver in a defined manner. Furthermore, the drafting system can be driven reversibly to enable a correction of the sliver feed or a defined retraction of the fed sliver if necessary. Such a defined feeding of the sliver can ensure that on the one hand the sliver is first relatively carefully fed to and connected to the prepared yarn end of the yarn and on the other hand that after a certain period of time, in other words after a certain running-in phase, the air-jet spinning device can produce again at normal working speed. The drives of the drafting system and the yarn take-up device can be controlled independently of each other in a preferred manner, e.g. via a central control of the spinning machine or via a workstation, in order to enable an effective and demand-oriented interaction between these two devices.

In accordance with a second aspect of the present invention, a yarn guide channel for arrangement between a spinning device and a winding device of a spinning machine such as an air-jet spinning machine producing a take-up package is proposed, in particular for carrying out a process described above in accordance with one of the preferred embodiments, in which case the yarn guide channel forms a passage channel for a yarn running between the spinning device and the winding device. The yarn guide channel has a plurality of pneumatically engageable channel sections coupled to each other, comprising at least a first channel section, a second channel section and a channel connection section disposed between the first and second channel sections, in which the channel connection section has an orifice for supplying compressed air into the yarn guide channel for generating a pneumatic overpressure in the first channel section associated with a pneumatic suction effect in the second channel section. The first channel section, the second channel section and the channel connection section can each be made up of individual or several composite elements. Alternatively or in addition, at least one of these sections can be formed from a single integral component in conjunction with at least one further section of the yarn guide channel. Alternatively, at least two of these sections can be formed from a single integral component In other words, the yarn guide channel is designed to be arranged in a defined area between the spinning device and the winding device, in particular between the spinning device and usually one of its downstream yarn take-up devices, in which case at least a portion of a yarn path running between these devices passes through the yarn guide channel. With regard to the process described above in accordance with the first aspect of the present invention, the yarn end is preferably transferred through the yarn guide channel into the area of the outlet opening of the spinning cone using the yarn guide channel with the step of transferring the processed yarn end into the area of the outlet opening of the spinning cone. The yarn end can preferably be transferred by means of the reversibly drivable yarn take-up device driven by a single motor.

The mouth arranged in the channel connection section makes it particularly advantageous for a yarn end inserted into the yarn guide channel to be guided automatically by means of pneumatic accompaniment. The mouth can preferably be configured as a bore or as an annular gap. Depending on the arrangement of the first and second channel sections, the yarn end inserted can thus be guided pneumatically either in the direction of the spinning device or in the direction of the winding device.

In accordance with a preferred embodiment, the first channel section, then the channel connection section and then the second channel section are connected downstream of the spinning device in the direction of yarn travel, which is identical to the direction of the sliver. With this preferred embodiment, a yarn end inserted in the second channel section can be guided pneumatically over the first channel section in the direction of the spinning device in the course of a piecing process.

In accordance with an alternatively preferred embodiment, first the second channel section, then the channel connection section and then the first channel section can be connected downstream of the spinning device in the direction of yarn travel. With this preferred embodiment, a yarn end inserted in the second channel section can be guided pneumatically over the first channel section in the direction of the winding device in the course of a splicing process. In a further preferred embodiment, this makes it possible, for example, to provide a splicing device for connecting two yarn ends, which has long since been disclosed in the technical field of the winding machines, between the yarn guide channel and the winding device. In accordance with a further preferred embodiment, a splicing device could be provided at a service unit supplying the workstations of the spinning machine or per workstation. In addition, it would only be necessary to provide a device for transferring the yarn end guided from the yarn guide channel to the splicing device, such as, for example, a gripper tube also disclosed in the technical field of winding machines. Such a preferred embodiment makes it possible to avoid a piecing process in the event of a yarn break and to establish the yarn joining by means of a spliced joint.

In accordance with an alternatively preferred embodiment, the yarn guide channel, preferably the channel connection section, has a second mouth which counteracts the first mouth in such a way that compressed air is supplied into the yarn guide channel to generate a pneumatic overpressure instead of the first channel section in the second channel section accompanied by a pneumatic suction effect instead of the second channel section in the first channel section. In the sense of the present invention, a first channel section is understood in the following to refer to a channel section of the yarn guide channel in which a pneumatic overpressure is generated by supplying compressed air through the associated inlet. A second channel section is defined as a channel section of the yarn guide channel in which a suction effect is generated by compressed air being supplied via the associated mouth or a further mouth. One and the same channel section of the yarn guide channel thus forms a first or second channel section depending on the supply of compressed air via the mouth or via the further mouth. For this purpose, the first and second mouths are designed to be controlled with compressed air as required. By means of such a preferred embodiment, a device can be provided with which, in the event of a yarn break, a choice can be made between a piecing process and a spliced joint as required. The selection can be set or is adjustable on the program or control side in such a way that the piecing process or the spliced joint is carried out depending on a location of the sliver or yarn interruption. Further criteria that are significant in terms of textile technology can of course be used as selection criteria.

In accordance with another preferred embodiment, the yarn guide channel, in particular the channel connection section, has a yarn deflecting section for deflecting the yarn. A passage axis of a channel section of the yarn guide channel, in particular of the first channel section on one side of the yarn deflection section which extends along the yarn path or yarn guide axis running in the channel section or the first channel section, runs transversely in a projection plane, i.e. with an enclosed angle not equal to 180°, to a corresponding passage axis of a channel section of the yarn guide channel arranged on the other side of the yarn deflection section, in particular of the second channel section. This means that both the yarn guide channel and the spinning machine as a whole can be designed to save space in the yarn guide channel area.

In a further preferred manner, a mouth can be provided and configured with the yarn guide channel in such a way that a passage axis of the mouth, which runs perpendicular to a passage plane spanned by the mouth opening, extends in parallel, and in a further preferred embodiment congruently, to the yarn guide axis or the passage axis of the first channel section and transversely to the yarn guide axis of the second channel section. The overpressure and suction effect can thus be effectively generated in the respective first and second channel sections, avoiding or reducing flow vortices which would otherwise be problematical. Furthermore, a compressed air connection co-operating with the mouth can be easily accessible from the outside at the yarn guide channel or can be designed with it.

Furthermore, in accordance with a preferred embodiment, the yarn guide channel can have a fastening section for fastening the yarn guide channel to a housing or frame section of a workstation of the spinning machine, in particular a detachable one. The yarn guide channel can be arranged in a modular way on the spinning machine and can also be exchanged or dismantled if necessary in accordance with the further preferred embodiment.

In addition, the fastening section preferably forms a housing for accommodating at least the yarn deflection section or is arranged on such a housing. This allows the yarn guide channel to be made more compact. For example, the housing can also have the compressed air connection assigned to the mouth or the other mouth. Furthermore, the housing can preferably accommodate the channel section of the yarn guide channel closest to the spinning device in the direction of yarn travel, in which case additional sealing measures such as O-rings or the like can be reduced and the yarn guide channel itself can be designed more easily.

A yarn end preparation device having at least one small holding and opening tube for preparing the yarn end is provided in another preferred embodiment, in which the small holding and opening tube is arranged or formed at one end of the yarn guide channel near the take-up package. Small holding and opening tubes are widely disclosed, which is why a detailed description of their design is not necessary in the following. In the course of a piecing process, the yarn end can first be opened or prepared before entering the channel connection section by means of the small holding and opening tube and then guided in the direction of the spinning device in the already opened or prepared state.

It is advantageous for at least one small holding and opening tube to form a channel section of the yarn guide channel, in particular the second channel section. This allows the yarn guide channel to be designed in a more compact and simplified design. The mouth can be arranged in a further preferred manner adjacent to the small holding and opening tube. This saves a compressed air connection, which could only be used to supply compressed air for opening or preparing the yarn end. By means of the mouth, the yarn end can be threaded into the small holding and opening tube on the one hand in conjunction with opening or preparing the yarn end, and on the other hand, the prepared yarn end can be pneumatically guided via the first channel section into the spinning device. The compressed air supply can be automatically controlled in the preferred way in order automatically to provide the compressed air intensity required for the opening process and the yarn guiding process in different ways, if necessary. If required, a compressed air sensor can be arranged in a further preferred way to detect the prevailing compressed air intensity.

Furthermore, in accordance with an embodiment, one end of the yarn guide channel close to the spinning device is preferably nozzle-like or adjoins a nozzle-like element. The nozzle-like end of the yarn guide channel can be designed in accordance with a preferred embodiment by the corresponding end of the channel section closest to the spinning device in the direction of the yarn travel. The nozzle-like element can preferably be designed in such a way that the nozzle-like element forms an insert element which can be inserted and removed non-destructively at the end of the yarn guide channel. Depending on the type of yarn to be produced, a suitable nozzle end can be used for defined pneumatic guiding of the yarn end in the direction of the spinning device without the yarn guide channel itself having to be replaced.

In a further preferable embodiment, the yarn guide channel end close to the spinning device or the nozzle-like element is arranged spaced apart from a funnel inlet of a yarn guide funnel leading to the spinning device, the spacing being selected such that a yarn end leaving the end of the yarn guide channel or the nozzle-like element close to the spinning device can be guided at least into the funnel inlet by means of the compressed air generated in the channel connection section. The intensity of the compressed air accompanying the yarn end can thus be suitably reduced or controlled when leaving the yarn guide channel and before entering the area of the spinning device. Preferably, at least one further yarn passage follows the funnel inlet in the direction of the spinning device, the yarn passage inlet of which is arranged at a distance from an outlet of the funnel outlet following the funnel inlet in the direction of the spinning device. In this way, the intensity of the compressed air accompanying the yarn end can be further reduced in a way that can be controlled as required.

In accordance with a third aspect of the present invention, an air-jet spinning machine is proposed which comprises an air-jet spinning device for spinning a yarn from a supplied sliver, a yarn take-up device driven by a single motor for taking the yarn out of the air-jet spinning device and a winding device for winding the spun yarn. The air-jet spinning machine further has a yarn guide channel in accordance with one of the preferred embodiments described above, the yarn guide channel being arranged between the air-jet spinning device and the downstream winding device, in particular between the air-jet spinning device and the yarn take-up device driven by a single motor upstream of the winding device. The yarn take-up device is additionally reversibly drivable for feeding the yarn in the direction of the air-jet spinning device and can be controlled accordingly. In accordance with an alternative embodiment, the yarn take-up device can be equipped with a winding device that can be driven by a single motor. With such an air-jet spinning machine in accordance with the third aspect, the advantages described above can be achieved in the same way.

The invention is explained in greater detail below on the basis of embodiment examples shown in the drawings.

BRIEF DESCRIPTION OF THE DRAWINGS

The present invention will become more fully understood from the detailed description and the accompanying drawings, which are not necessarily to scale, wherein.

DETAILED DESCRIPTION OF THE INVENTION

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Figure 1:
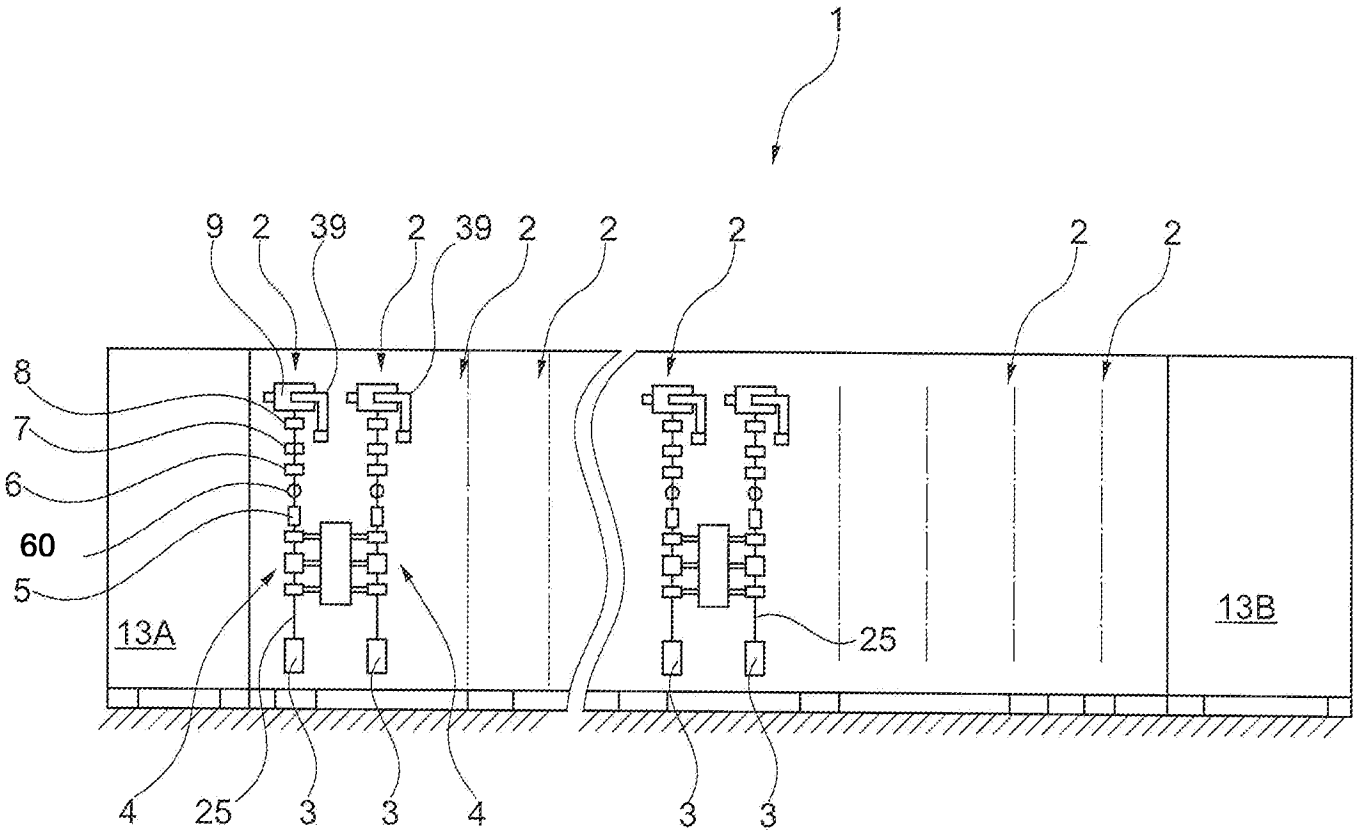
FIG. 1 shows a front view of an air-jet spinning machine with workstations each having a suction nozzle suitable for workstations and a yarn end preparation device for supplying its air-jet spinning device.

Referring to the figures, FIG. 1 shows a schematic front view of a textile machine usually manufacturing a take-up package referred to as a cross-wound package 9, in this case an air-jet spinning machine 1.

Such textile machines 1 have a large number of workstations 2 between machine frames 13A, 13B arranged at the machine end. These workstations 2, which are arranged in a row next to one another and are usually identically designed, are also known as spinning positions. A spinning can 3 is positioned at each of the workstations 2, which is provided with a supply of feed material, for example with sliver 25.

Furthermore, the workstations 2 each have a drafting system 4, an air-jet spinning device 5, a yarn take-up device 6, a yarn clearer 7 and a yarn traversing device 8, which ensures that the yarn 36 spun or produced in the air-jet spinning device 5 from the sliver 25 is wound in crossing layers onto a take-up package 9. The so-called cross-wound package 9 produced during the spinning process is held, in the usual way, in a package cradle (not shown) and is rotated by a package drive (also not shown).

Each of the workstations 2 is also equipped with a suction nozzle 39, which makes it possible to pick up a yarn end 37 of a finished yarn 36 which has run onto the cross-wound package 9 after a spinning interruption and to transfer it to a so-called yarn end preparation device 40 arranged in the area of the yarn take-up device 6.

Figure 2:
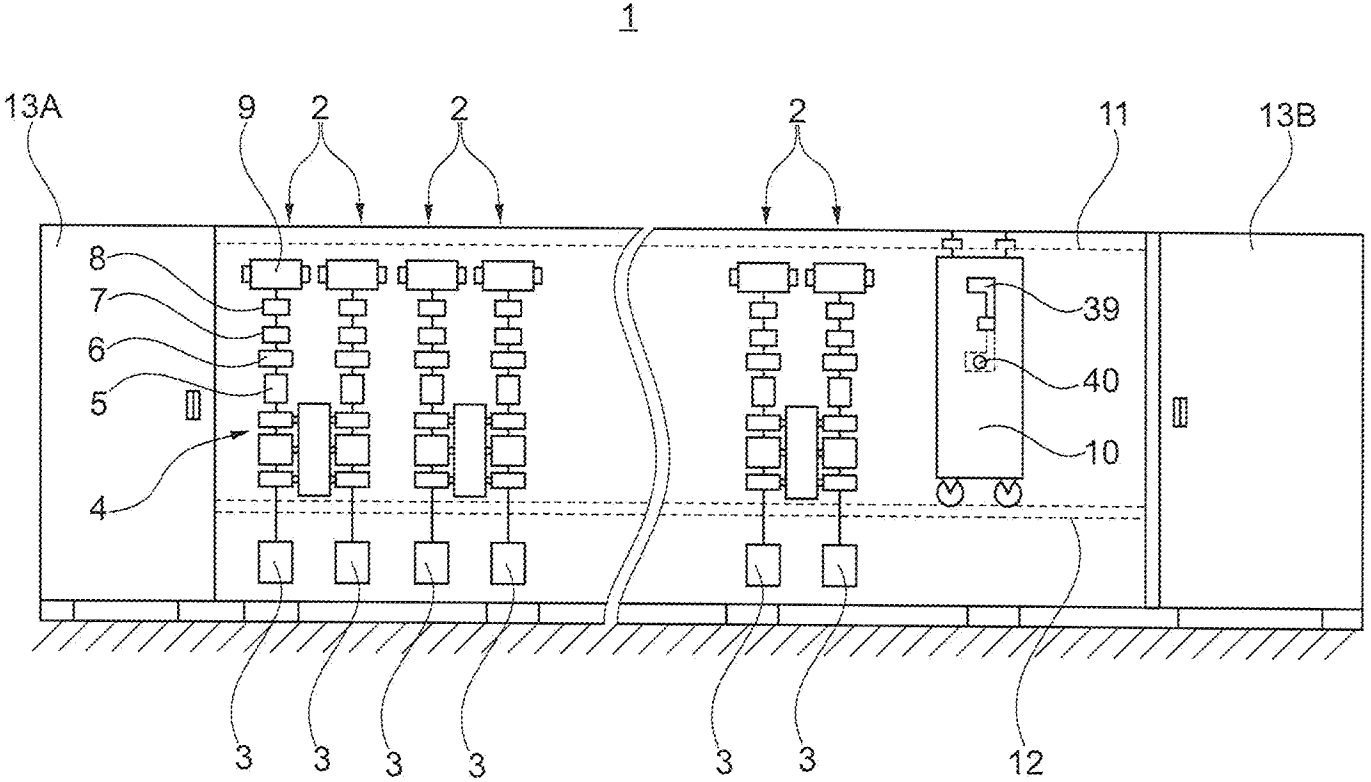
FIG. 2 shows a front view of an alternative embodiment of an air-jet spinning machine with workstations which are supplied by a mobile service unit, in which the service unit has a suction nozzle for receiving a yarn accumulated on the cross-wound package and a yarn end preparation device.

The only difference between the embodiment of an air-jet spinning machine 1 shown in FIG. 2 and the air-jet spinning machine in accordance with FIG. 1 is that the spinning positions 2 have neither their own suction nozzle nor their own yarn end preparation device, but that, after a spinning interruption, the workstations 2 are supplied by an automatically operating service unit 10, which is guided on rails 11, 12 and can be moved along the workstations 2. This means that in the event of a spinning interruption, the service unit 10 positions itself at the relevant workstation 2, uses its suction nozzle 39 to pick up the yarn end 37 of the yarn 36 accumulated on the cross-wound package 9 after the spinning interruption and transfers the picked-up yarn end 37 to a yarn end preparation device 40 belonging to the service unit. In the yarn end preparation device 40 of the service unit 10, the yarn end 37 of the yarn 36 is then prepared for a subsequent piecing operation.

However, in other designs not shown in the embodiment examples, there may also be provision for the suction nozzle of the service unit to transfer the picked-up yarn to a yarn end preparation device at the workstation.

Figure 3:
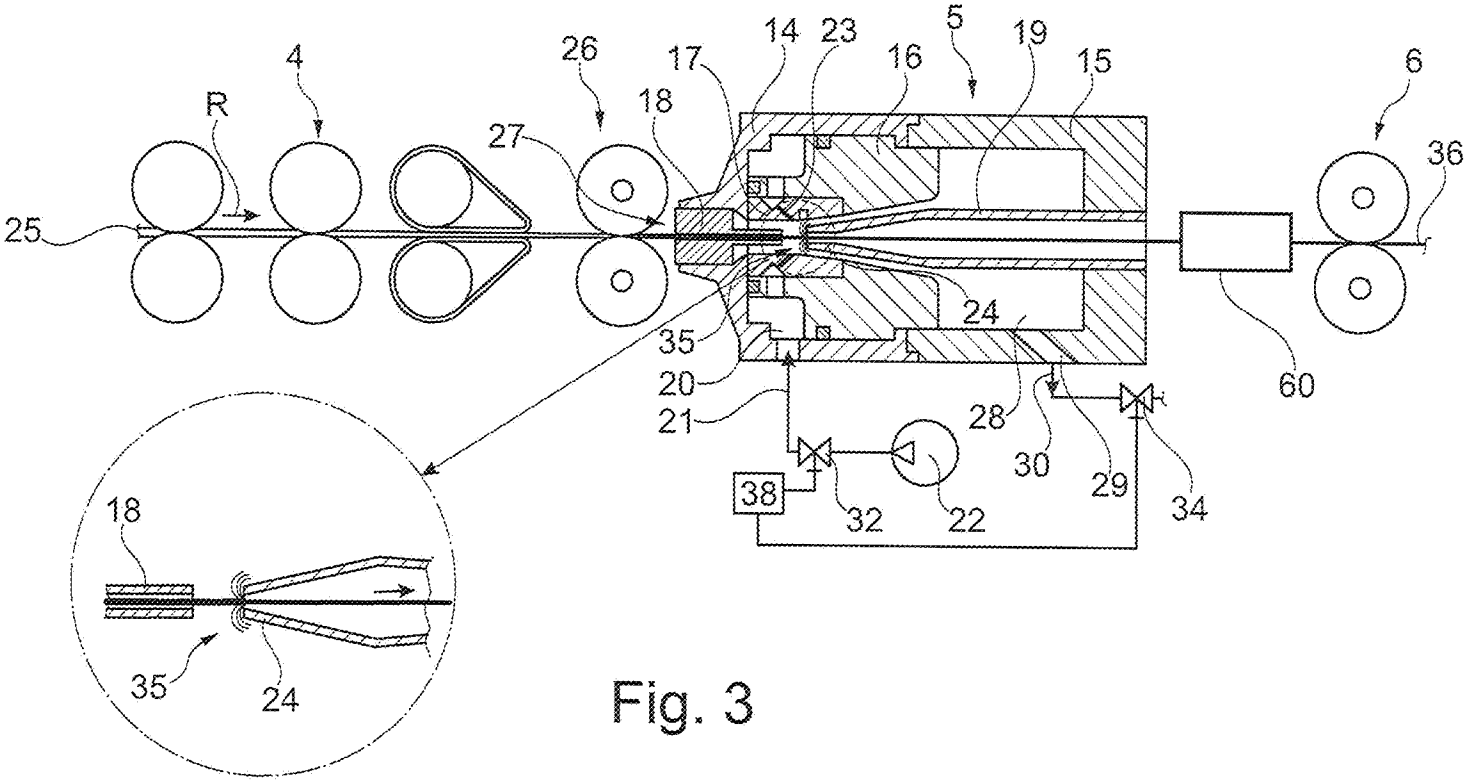
FIG. 3 shows schematically, in section, an air-jet spinning device during spinning operation.

FIG. 3 shows a side view and a larger scale of an air-jet spinning device 5 suitable for carrying out the process in accordance with a preferred embodiment example during the normal spinning process.

As can be seen, the air-jet spinning device 5 shown in the section is preceded by a drafting system 4 for warping a sliver 25. A reversibly drivable yarn take-up device 6 driven by a single motor is installed behind the air-jet spinning device 5 in the direction R of the sliver run, which ensures that the produced yarn 36 can be conveyed in the direction of the take-up package 9 and in the opposite direction.

Figure 4:
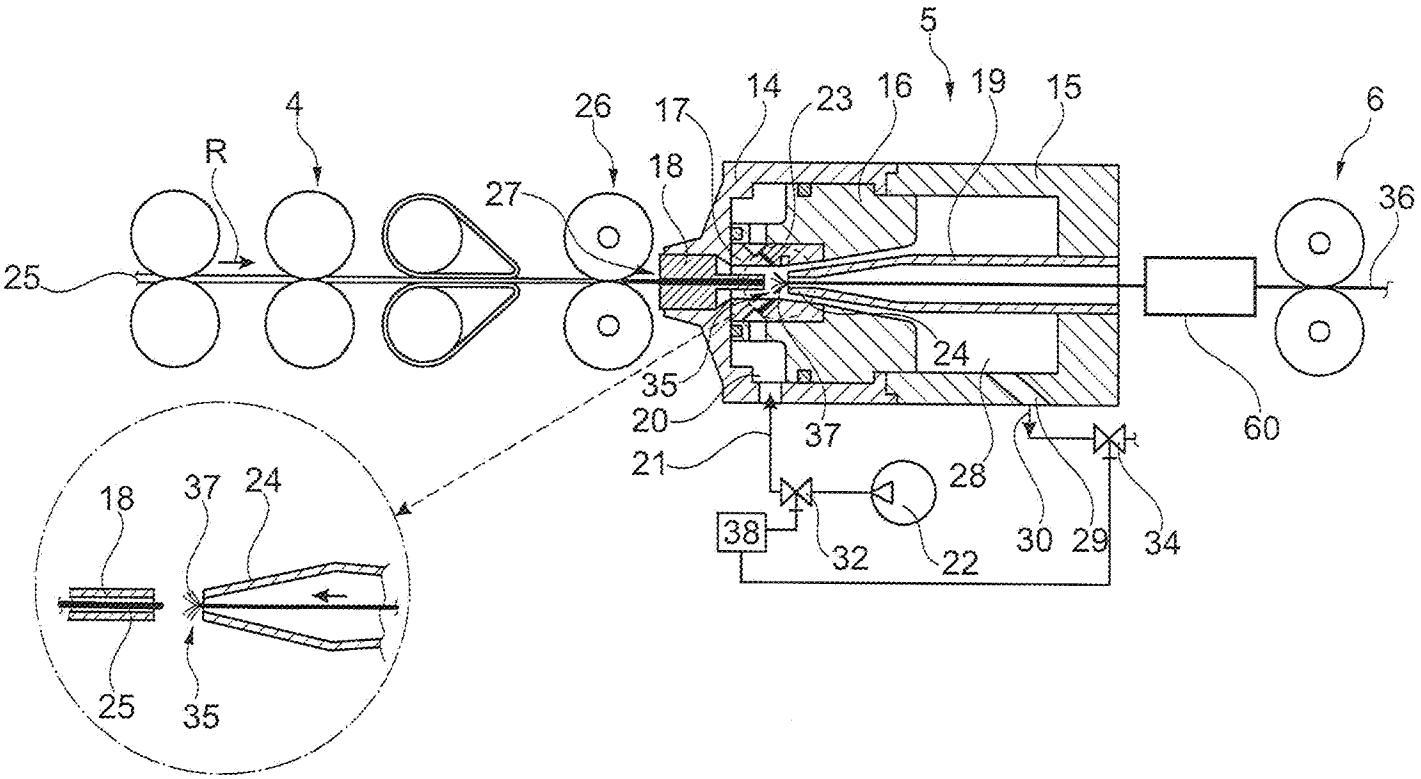
FIG. 4 shows the air-jet spinning device in accordance with FIG. 3 during the piecing process.

In addition, a yarn preparation device 40, not shown in FIGS. 3 and 4, is arranged in the area of the yarn take-up device 6, which prepares the yarn end 37 of the finished yarn 36 brought back by the suction nozzle 39 for the subsequent piecing process.

Such yarn end preparation devices 40 are known in principle and described in relative detail in DE 35 18 316 A1 or DE 102 02 781 A1, for example.

As will be explained in more detail later on using FIG. 5, such a yarn end preparation device 40 has a pneumatically actuated small holding and opening tube 31.

As shown in FIG. 3, the air-jet spinning device 5 essentially consists of a two-part outer housing 14, 15, an expansion housing 16, a nozzle block 17, a sliver guide 18 and a hollow spinning cone 19.

The expansion housing 16 forms a front annular space 20 in connection with the front housing part 14 of the outer housing, which is connected via a pneumatic line 21 to an overpressure source 22 and in connection with the rear housing part 15 of the outer housing forms an expansion space 28.

While the expansion chamber 28 is indirectly connected to the ambient atmosphere via an exhaust air duct 29, the annular space 20 is pneumatically connected to at least one blowing air nozzle 23, which is arranged in the nozzle block 17.

The blowing air nozzle 23 is directed tangentially at the head 24 of the spinning cone 19 in the area of the inlet opening 35 of the spinning cone 19 in such a way that a rotating air flow is generated. The spinning cone 19 is preferably made of a highly wear-resistant material, for example a technical ceramic material.

To control the compressed air supply, pneumatic line 21 is equipped with a valve 32, which is preferably actuated by a control device 38 belonging to the spinning position, which is connected to the valve via corresponding control lines.

During the normal, previously disclosed spinning process shown in FIG. 3, each sliver 25 stored in a spinning can 3 first passes through the drafting system 4 on its way to the cross-wound package 9, where it is strongly warped. The pair of outlet rollers 26 of drafting system 4 then transfer the warped sliver 25 to the area of the inlet opening 27 of the air-jet spinning device 5 where it is sucked into the air-jet spinning device 5 under the influence of a vacuum flow present there. Inside the air-jet spinning device 5, the warped sliver 25 passes over the sliver guide 18 and the nozzle block 17 to the inlet opening 35 of the hollow spinning cone 19 and is pulled into the spinning cone 19 by the yarn 36 forming inside the spinning cone 19. The sliver 25 is exposed to the influence of a rotational flow in the area of the head 24 of the spinning cone 19, which is generated by the air flow emerging from nozzle block 17.

The valve 32 is open for the defined supply of this air flow initiated by compressed air source 22 to nozzle block 17. A valve 34 connected to the control device 38 via a corresponding control line is open to allow the air flow flowing in via nozzle block 17 to flow via pneumatic line 30 out through the exhaust air duct 29 during the spinning process to the ambient atmosphere or to an extraction system belonging to the machine.

During the spinning process, due to the continuous movement of the sliver 25 in the sliver run direction R, the sliver 25 is continuously drawn into the hollow spinning cone 19, in which case the edge fibres are helically looped around the core fibres of the sliver 25. The yarn 36 produced in this way is pulled out of the air-spinning device 5 by means of the yarn take-up device 6 and then wound into a cross-wound package 9.

If a spinning Interruption occurs during the spinning process, for example due to a break in the sliver 25 or due to a controlled cut of the already spun yarn 36 by yarn clearer 7, a piecing process must first be carried out before restarting the spinning process.

To carry out a piecing process, the warped sliver 25 is required on the one hand and the yarn 36, which has already been spun onto the cross-wound package 9, on the other.

In the process in accordance with the present invention with an embodiment example, the yarn end 37 of the already completed yarn 36 is first retrieved from the cross-wound package 9 after a spinning interruption, e.g. by a suction nozzle 39 of the workstation concerned 2, and is transferred to a yarn end preparation device 40 equipped with a small holding and opening tube 31, and is preferably connected downstream of the air-jet spinning device 5 in the sliver run direction R, as shown by way of example in FIGS. 5 to 8. In the small holding and opening tube 31, the yarn end 37 is largely freed of twist and loose fibres.

Figure 5:
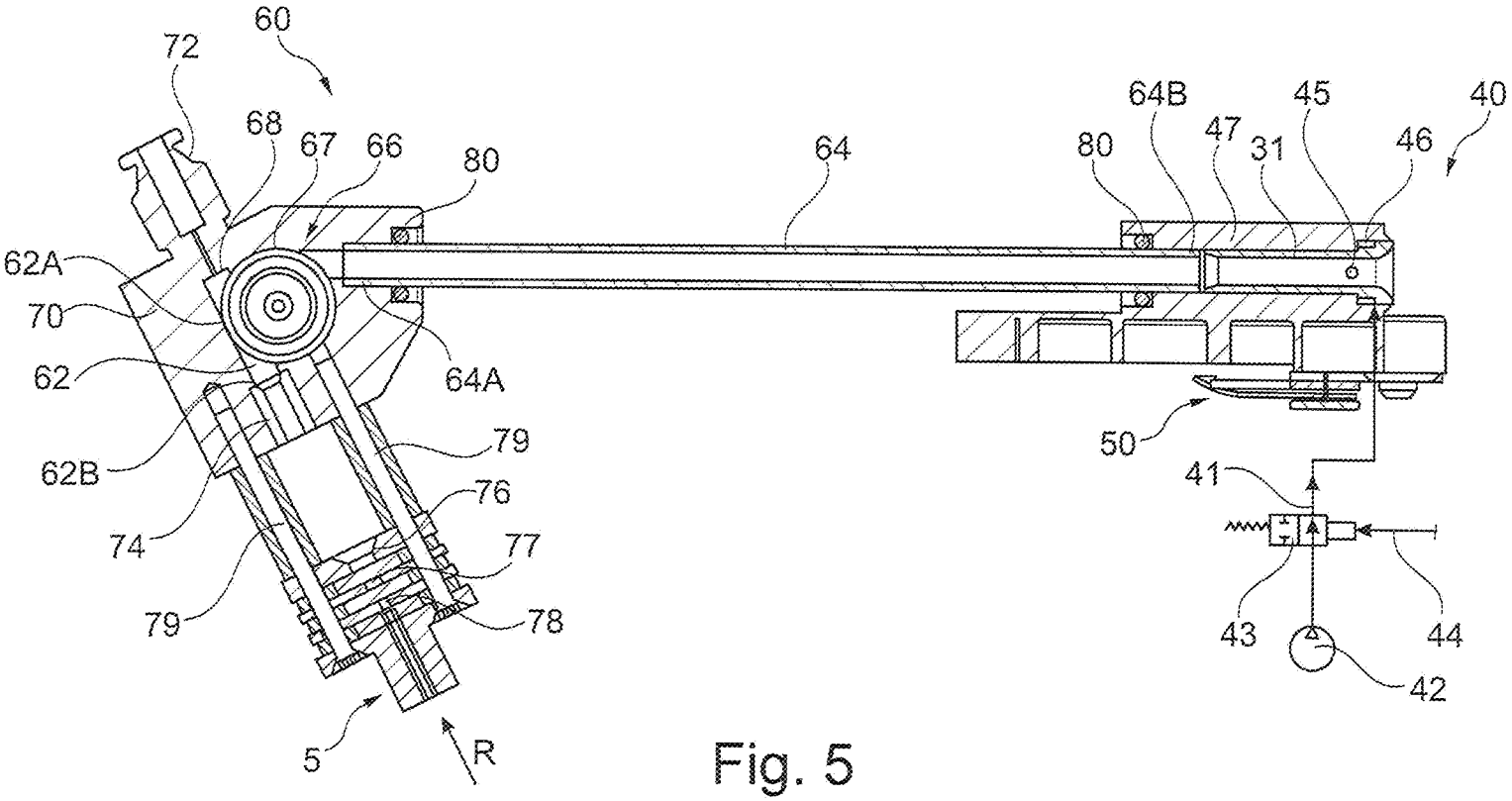
FIG. 5 shows a yarn guide channel in accordance with an embodiment example which can be used with an air-jet spinning machine as shown in FIGS. 1 and 2.
Figure 6:
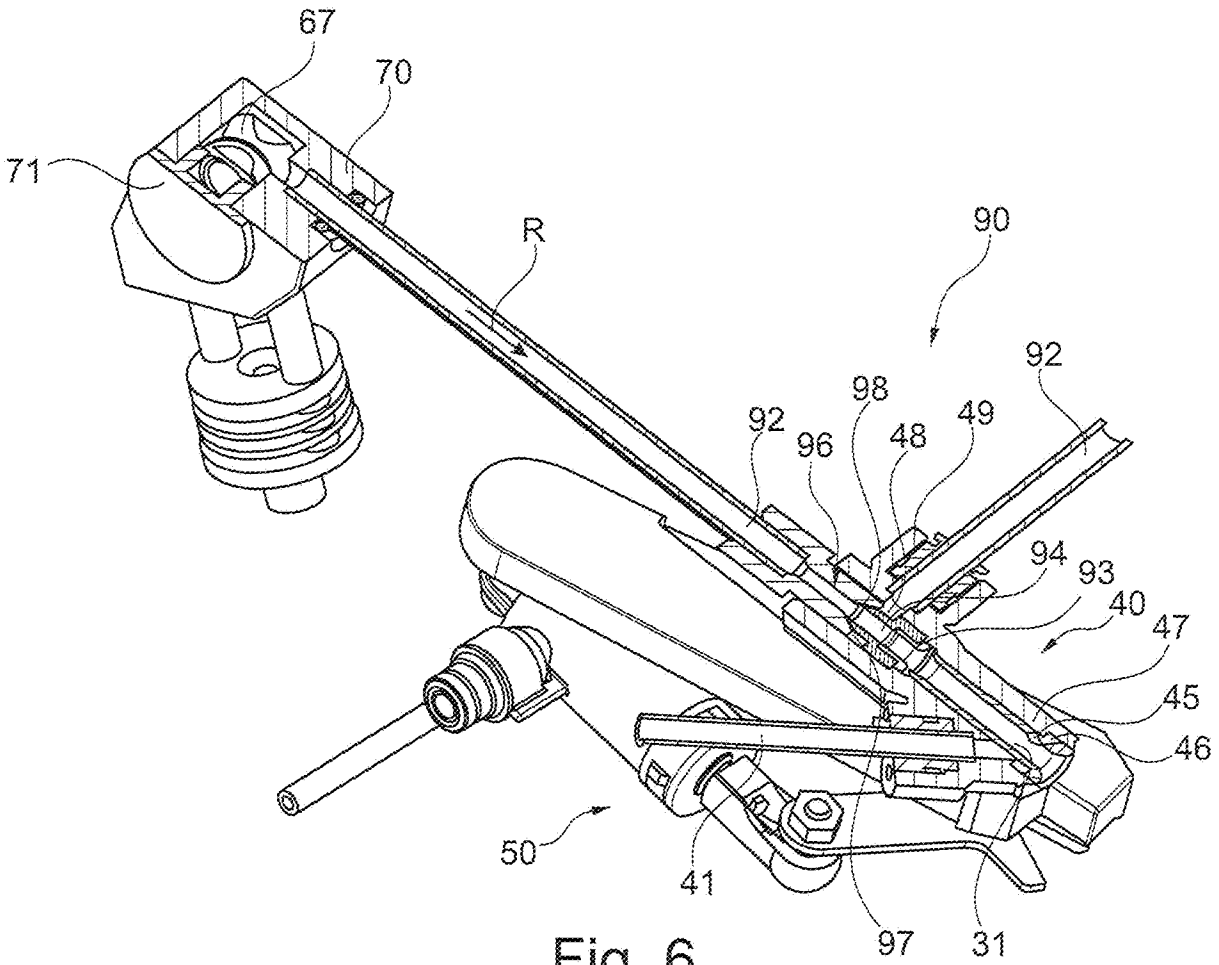
FIG. 6 shows a yarn guide channel in accordance with an embodiment example in a cut perspective plan view.
Figure 7:
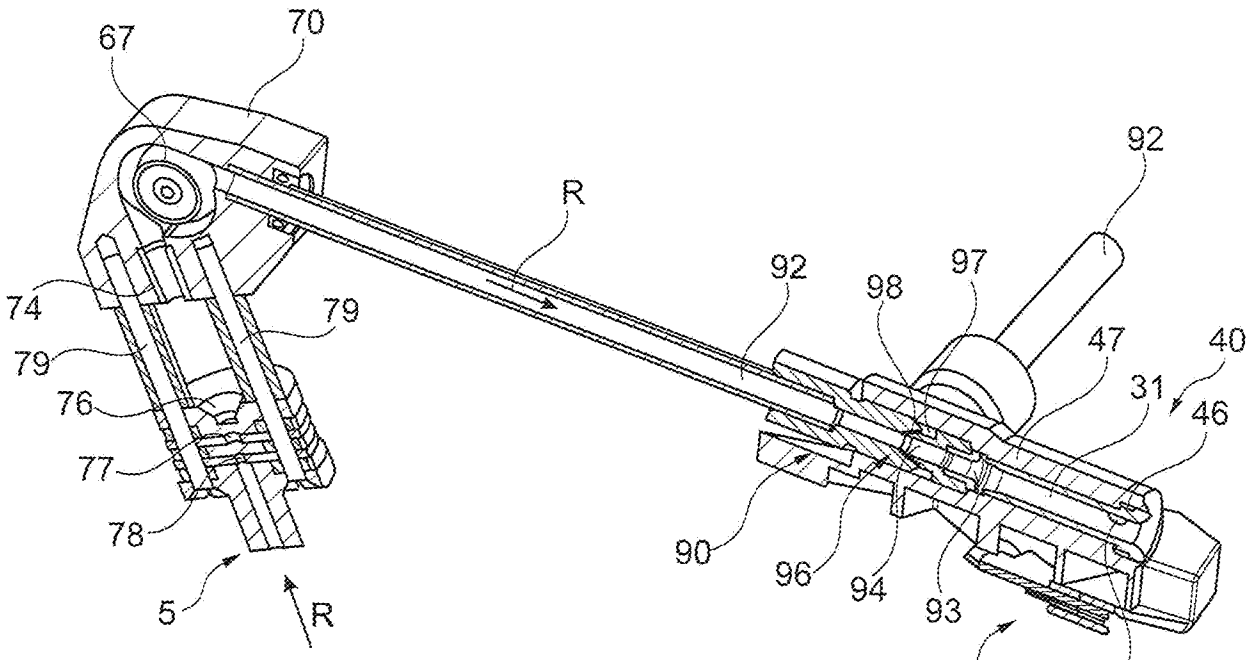
FIG. 7 shows the yarn guide channel shown in FIG. 6 in a cut perspective side view.

As shown in FIGS. 5 to 7, the yarn end preparation device 40 is equipped with a small holding and opening tube 31 arranged in an accommodation housing 47. The housing 47 has an annular space 46, to which a compressed air source 42 is connected via a pneumatic line 41. A valve 43 is connected to pneumatic line 41, which is connected via control line 44 for example to the control unit 38 of workstation 2 (not shown in FIGS. 5 to 7). The small holding and opening tube 31 is equipped with at least one blowing nozzle 45, which is connected to the annular space 46.

As is known, a yarn must first be inserted into a small holding and opening tube 31 to prepare its yarn end for a yarn joining process. This means that the yarn 36 brought back by a suction nozzle 39 from a cross-wound package 9 is provided by the suction nozzle 39 at the yarn end preparation device 40 in such a way that it can be pneumatically threaded into the small holding and opening tube 31. For this purpose, the yarn end preparation device 40 can work together with at least one cutting device 50, which cuts the recovered yarn 36 to the required length, as shown in FIGS. 5 to 7 as an example. During the cutting process, the valve 43 is actuated and compressed air is blown into the small holding and opening tube 31 via the blowing nozzle 45 in order to pneumatically thread or suck in the cut yarn end 37 into the small holding and opening tube 31. The threaded-in yarn end 37 is freed from twist and loose fibres in the small holding and opening tube. If necessary, a clamping device can also be provided which clamps the yarn in the known manner before the cutting process. The clamping device can be combined with the cutting device in a further preferred way.

As is further shown with FIGS. 5 to 8, the yarn end preparation device 40 is coupled to a yarn guide channel 60 for passing through the yarn 36, the yarn guide channel 60 being arranged directly adjacent to the yarn end preparation device 40 between the air-jet spinning device 5 and the yarn end preparation device 40 in the sliver run direction R. The sliver run direction R is identical to the direction of travel of the yarn in the spinning operation of the air-jet spinning machine, in which the yarn 36 is spun by means of the air-jet spinning device 5.

The yarn guide channel 60 in accordance with the embodiment example shown in FIG. 5 comprises a first channel section 62 and a second channel section 64 with a channel connection section 66 in an intermediate position. The first channel section 62 and the channel connection section 66 are accommodated by a housing 70. The housing 70 has a fastening section not shown for fastening the yarn guide channel 60 to a frame or housing 100 of a workstation 2 of the air-jet spinning machine 1, as shown as an example in FIG. 8. A first end 64A of the second channel section 64 ends in the housing 70 with a sealing effect, in which case an O-ring 80 is in an intermediate position. A second end 64B of the second channel section 64 ends with a sealing effect in the accommodating housing 47 of the yarn end preparation device 40 with another O-ring 80 in an intermediate position in accordance with the embodiment example shown in FIG. 5, in which case the second end 64B lies directly against the associated end of the small holding and opening tube 31 and forms a common channel passage for the yarn 36 and the yarn end 37 respectively.

The channel connection section 66 comprises a yarn deflecting section 67 for deflecting the yarn 36 between the first 62 and second channel sections 64. The yarn deflection section 67 is embodies with a circular arc cross-section, the end 64A of the second channel section 64 projecting into the housing 70 and connected to the channel connection section 66 is coupled via the circular arc-shaped yarn deflection section 67 to a first end 62A of the first channel section 62 connected to the channel connection section 66 for passing the yarn 36 between the air-jet spinning device 5 and the yarn end preparation device 40. The yarn guide channel 60 thus forms a section that partially encloses the yarn travel. In addition, an angle of less than 180° is formed between the first 62 and second channel section 64; in the embodiment example shown this is less than 90°. The yarn guide channel 60 can consequently be designed compactly. The fastening section can be provided on one side of the yarn guide channel 60 without difficulties, this facing away from the side enclosing the angle.

The housing 70 also comprises a receptacle for a compressed air connection 72, for example in the form of an injector, via which compressed air can be supplied via an orifice 68 into the first channel section 62 for generating pneumatic overpressure, in which case a suction effect is simultaneously produced in the second channel section 64. The mouth 68 adjoins the first end 62A of the first channel section 62 and supplies the compressed air in parallel, in particular congruently, to a yarn guide axis of the first channel section 62 and transverse to a yarn guide axis of the second channel section 64. The yarn guide axis is the axis along which the yarn is guided in the yarn guide channel 60 or in the respective channel sections 62, 64, 66.

The second end 62B of the first channel section 62 adjoins a nozzle insert 74 accommodated in the housing 70, which is preferably non-destructively replaceable and removable. Via this nozzle insert 74, the yarn end 37, which is guided with compressed air from the first channel section 62, is blown in the direction of a funnel inlet 76, which is located at a distance from the outlet of nozzle insert 74. In accordance with an embodiment example, the distance between the outlet of nozzle insert 74 and the funnel inlet 76 cannot be changed relative to one another but can be adjusted variably in accordance with a further embodiment example, in which case a reduction in the intensity of the compressed air conducting the yarn end can be achieved in each case. In other words, a proportion of the compressed air conducting the yarn end 37 can escape in the space formed between the outlet of the nozzle insert 74 and the funnel inlet 76, while the remaining proportion conducts the yarn end 37 into the funnel inlet 76. The funnel inlet 76 is followed by two further yarn passes 77, 78 in the direction of the air-jet spinning device 5 in accordance with this embodiment example, between each of which further spaces are formed for the escape of a defined proportion of compressed air before the yarn end 37 can enter the air-jet spinning device 5 against the yarn sliver or yarn run direction R. The funnel inlet 76 with the intermediate yarn passages 77, 78 is held between the housing 70 and the air-jet spinning device 5 by means of fastening screws 79. The air-jet spinning device 5 and the housing 70 are coupled together by means of the fastening screws 79. In particular, in accordance with a further embodiment example, a position of the funnel inlet 76 and/or the intermediate yarn passages 77, 78 can be variably adjusted along the fastening screws as required in order to be able to adjust the proportion of compressed air escaping in the individual sections. By arranging the yarn or the prepared yarn end 37 in accordance with one of these embodiment examples, it can be gently guided to the air-jet spinning device 5. The yarn end 37, prepared as above and transferred to the air-jet spinning device 5, is then connected to the sliver 25 fed by the drafting system 4.

The feeding of the prepared yarn end 37 ends when the prepared yarn end 37, as shown in FIG. 4, is positioned at somewhat of a distance in front of the spinning cone 19 inlet opening 35 within the air-jet spinning device 5. To ensure that the yarn end 37 is always correctly positioned, the yarn take-up device 6 is driven by a single motor, e.g. a stepper motor, which is controlled in such a way that by detecting the number of steps of the stepper motor, the yarn take-up device 6 is driven reversibly, i.e. against the yarn take-up direction prevailing in spinning operation, in order to be able to effect a defined demand-oriented return of the yarn end 37 accompanied by the air flow prevailing in the yarn guide channel 60 along the direction pointing from the yarn take-up device 6 to the air-jet spinning device 5 until the predetermined position is reached. Preferably, a sensor connected to the control device 38 can be provided in the area of the nozzle block 17 and the inlet opening 35 of the spinning cone 19, by means of which the correct positioning of the yarn end 37 can also be confirmed.

As soon as the yarn end 37 has reached its predetermined position, the control device 38 causes the valves 32 and 34 to switch over in such a way that compressed air is applied to nozzle block 17 again. At the same time, the individually motor-driven drafting system 4 and the yarn take-up device 6 are controlled in such a way that a free end of the sliver 25 initially comes into contact with the prepared yarn end 37 of yarn 36, the sliver 25 swirls with the prepared yarn end 37 of yarn 36 and they are connected to one another in such a way that a new draw-off yarn is produced which can be drawn off from the air-jet spinning device 5 in a defined manner by means of the yarn take-up device 6. The piecing process thus transitions into the normal spinning process.

FIGS. 6 and 7 show a yarn guide channel 90 in accordance with a further embodiment example. This yarn guide channel 90 differs in design from the yarn guide channel 60 shown in FIG. 5 essentially in the location of the mouth 98. In detail, in comparison with the yarn guide channel 60 shown in FIG. 5, the mouth 98 is arranged in a section upstream of the small holding and opening tube 31 in the yarn run direction R. The mouth 98 is designed in the form of an annular gap directed against the yarn run direction R in order to introduce the compressed air to be blown in into the yarn guide channel 60 in the direction of the air-jet spinning device 5 or in a direction opposite the yarn run direction R. In the sense of the present invention, the channel section comprising the mouth 98 forms the channel connection section 96 of the yarn guide channel 90. The channel connection section 96 comprises a further annular space 97, which is coupled to the mouth 98 for supplying the compressed air. The annular space 97 is coupled via an opening 48 formed in the accommodation housing 47 to another pneumatic line 92, which ends in a receptacle 49 of the accommodation housing adjacent to opening 48.

In this embodiment example, the channel connection section 96 is located near the small holding and opening tube 31 with the second channel section 94 in an intermediate position. In this embodiment example, the second channel section 94 is coupled to the small holding and opening tube 31 for passing through the yarn end 37 via a nozzle element 93 arranged between them.

The channel connection section 96 adjoins the first channel section 92 on a side facing away from the second channel section 94. The design of the first channel section 92 in this embodiment example is therefore identical to the design of the second channel section 64 of the yarn guide channel 60 described in FIG. 5. in accordance with a further embodiment example which is not shown, the first channel section 92 can alternatively be designed as one piece with the channel connection section 96.

The first channel section 92 is followed in the direction of the air-jet spinning device 5 by a housing 70, which is approximately identical to the housing 70 described in conjunction with FIG. 5 with the yarn deflection section 67 and the nozzle insert 74 but without the mouth 68 and the injector 72 leading to the mouth 68. In this context, with regard to the design of the housing 70 and the nozzle insert 74 in accordance with this embodiment example, reference is made to the above description in conjunction with the following description.

As explicitly shown in FIG. 6, a passage closed by a cover element 71 leads to the yarn deflection section 67, via which the yarn deflection section 67 and thus the yarn deflection are accessible. Depending on the type of yarn to be processed, differently designed yarn deflection sections 67 can be inserted into the housing 70 or can be exchanged for the housing 70 via the passage. In accordance with a further embodiment example, the yarn deflection section 67 can be fixed in the housing 70 by means of the cover element 71.

In this embodiment example, the yarn deflection section 67 is essentially biconical, also known as diabolo form. The design of this specifically biconical as well as any other form of the yarn deflection section 67 can be suitably selected in accordance with the type of yarn to be guided. For example, the side surfaces of the biconical shape leading to the yarn guiding surface section can have a concave or convex curvature in cross-section, depending on the yarn requirement, or alternatively they may continue to be straight in cross-section. The width of the yarn guide surface section running perpendicular to the yarn deflection direction can be selected to suit the yarn type to be processed. The radius of the yarn deflection can also be selected to suit the yarn type.

Furthermore, the nozzle insert 74, the funnel inlet 76 and the further yarn passages 77, 78 follow the housing 70 in the direction of the air-jet spinning device 5 in the manner shown in FIG. 5 and in connection with this manner as is described and referred to.

Figure 8:
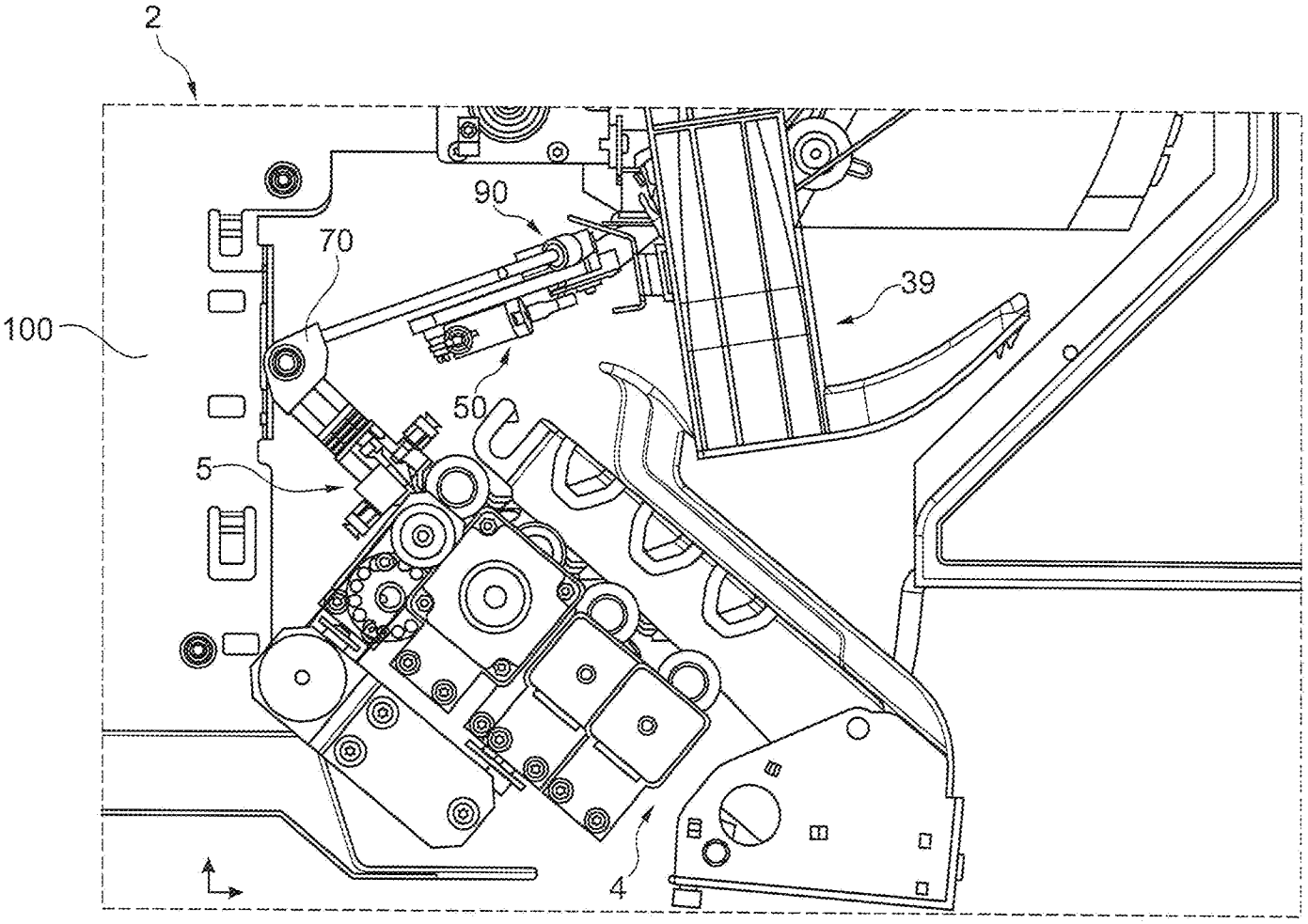
FIG. 8 shows a yarn guide channel as shown in FIGS. 6 and 7 when mounted at a workstation of an air-jet spinning machine.

FIG. 8 shows an example of a yarn guide channel 60 as shown in FIGS. 5 to 7 when mounted at a workstation 2 of air-jet spinning machine 1. In particular, it is made clear that the deflected configuration of the yarn guide channel 60 can be placed between the other devices arranged at workstation 2 in a space-saving manner in accordance with this embodiment example.

The yarn guide channel can be configured even more compactly in accordance with an embodiment example that is not shown, for example, the second channel section can be combined with the small holding and opening tube in such a way that the small holding and opening tube forms the second channel section, in which case the mouth is positioned, for example, in the form of an annular gap at the end of the small holding and opening tube or is formed in the end area of the small holding and opening tube. This allows compressed air to be supplied via the mouth in order to suck in the yarn end fed by means of the suction nozzle 39 and to immediately prepare or open the yarn end 37 and to pneumatically guide the prepared yarn end 37 in the yarn guide channel 60. This allows a gentle or less aggressive preparation of the yarn end 37. In addition, it is possible to dispense with a compressed air connection to be provided only for the opening of the yarn end 37.

The described embodiment examples shown in the figures are only selected by way of example. Different example embodiments can be combined with one another completely or with regard to individual characteristics. Also, an example embodiment can be supplemented by characteristics of a further example embodiment. For example, the housing can be designed as a swivel joint so that the angle enclosed by the yarn deflection section can be changed as required at the installation site and/or during the installation process. Alternatively, the mouth or, in addition, another mouth in the area of the first channel section can be arranged and designed in such a way that the compressed air is supplied transversely to the yarn guide axis of the first channel section. Furthermore, in accordance with an embodiment example, the first and second channel sections can run on different levels in order to ensure reliable, unhindered passage of the suction nozzle past the drafting system and the second channel section for feeding the caught yarn end into the area of the yarn end preparation device.

If an example embodiment has an "and/or" link between an initial characteristic and a second characteristic, this can be read in such a way that the example embodiment in accordance with an embodiment type possesses both the first characteristic and the second characteristic and, in accordance with a further embodiment type, possesses either only the first characteristic or only the second characteristic.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A process for operating an air-jet spinning device after a spinning interruption, in which a drafting system for warping a sliver is connected upstream of the air-jet spinning device in a direction of the sliver and a yarn take-up device for drawing off a yarn spun by the air-jet spinning device is connected downstream, the process comprising:

after a spinning interruption, a yarn end of the spun yarn run onto a take up package is picked up by a suction nozzle and transferred to a yarn end preparation device arranged downstream of the air-jet spinning device in the direction of the sliver run, the yarn end is processed in the yarn end preparation device and then transferred through a yarn guide channel, having a plurality of pneumatically engageable channel sections coupled to each other, into a first area of an outlet opening of a spinning cone, the yarn end is transported to a second area of an inlet opening of the spinning cone by the yarn take-up device, which is reversibly driven by a first single motor, and is positioned there within the air-jet spinning device at a distance in front of the inlet opening, the drafting system of a relevant workstation, which warps the sliver, is raised and the sliver is conveyed through a sliver guide of a nozzle block into the second area of the inlet opening of the spinning cone and there spun onto the prepared yarn end of the spun yarn, and the drafting system of the relevant workstation is driven by a second single motor.

2. The process in accordance with claim 1, characterised in that the yarn end of the spun yarn which has run onto the take-up package is picked up by the suction nozzle which is a component of each workstation of the air-jet spinning machine.

3. The process in accordance with claim 1, characterised in that the yarn end of the spun yarn which has run onto the take-up package is picked up by the suction nozzle which is a component of a mobile service unit supplying numerous workstations of the air-jet spinning machine.

4. The process in accordance with claim 1, characterised in that the yarn end preparation device has small holding and opening tubes for preparing the yarn end of the spun yarn for a piecing operation.

5. The process in accordance with claim 1, characterised in that the second single motor is driven reversibly.

6. An air-jet spinning machine comprising:

an air-jet spinning device for spinning a yarn from a supplied sliver, a yarn take-up device driven by a first single motor for pulling the yarn out of the air-jet spinning device, a drafting system driven by a second single motor for the defined warping and feeding of the supplied sliver, and a winding device for winding the spun yarn, characterised in that a yarn guide channel, through which a yarn end is transferred, having a plurality of pneumatically engageable channel sections coupled to each other, is arranged between the air-jet spinning device and the downstream winding device, in which the yarn take-up device is driven reversibly in addition to feeding the yarn in the direction of the air-jet spinning device and controlled accordingly.

7. The air-jet spinning machine in accordance with claim 6, characterised in that the drive of the drafting system is controllable independently of the drive of the fibre take-up device.

* * * * *